US008806680B2

(12) United States Patent
Ishida

(10) Patent No.: US 8,806,680 B2
(45) Date of Patent: Aug. 19, 2014

(54) BED FOR NURSING CARE

(76) Inventor: Takayuki Ishida, Ibaraki (JP)

( * ) Notice: Subject to any disclaimer, the term of this patent is extended or adjusted under 35 U.S.C. 154(b) by 0 days.

(21) Appl. No.: 13/876,271

(22) PCT Filed: Oct. 25, 2011

(86) PCT No.: PCT/JP2011/074571

§ 371 (c)(1),
(2), (4) Date: Mar. 27, 2013

(87) PCT Pub. No.: WO2012/057154

PCT Pub. Date: May 3, 2012

(65) Prior Publication Data

US 2013/0185870 A1 Jul. 25, 2013

(30) Foreign Application Priority Data

Oct. 26, 2010 (JP) ..... 2010-239177

(51) Int. Cl.

| | |
|---|---|
| ***A47B 13/00*** | (2006.01) |
| ***A47B 7/02*** | (2006.01) |
| ***A61G 7/02*** | (2006.01) |
| *A61G 7/015* | (2006.01) |

(52) U.S. Cl.

CPC . *A61G 7/02* (2013.01); *A61G 7/015* (2013.01); *A61G 2200/58* (2013.01)

USPC ..... 5/604; 5/605; 5/612; 5/613; 5/617; 5/618

(58) Field of Classification Search

USPC ..... 5/604, 605, 602, 612, 613, 617–619

See application file for complete search history.

(56) References Cited

U.S. PATENT DOCUMENTS

| | | | | |
|---|---|---|---|---|
| 5,461,738 | A * | 10/1995 | Kimura et al. | 5/604 |
| 5,535,464 | A * | 7/1996 | Salonica | 5/604 |
| 5,604,943 | A * | 2/1997 | Kimura et al. | 5/604 |
| 5,729,849 | A * | 3/1998 | Garakani | 5/618 |

(Continued)

FOREIGN PATENT DOCUMENTS

| | | |
|---|---|---|
| CN | 101011627 A | 8/2007 |
| JP | 648/1982 | 7/1982 |

(Continued)

OTHER PUBLICATIONS

International Search Report dated Jan. 17, 2012 in corresponding International Application No. PCT/JP2011/074571.

*Primary Examiner* — Robert G Santos
*Assistant Examiner* — David E Sosnowski
(74) *Attorney, Agent, or Firm* — The Law Office of Michael E. Kondoudis

(57) ABSTRACT

A bed for nursing care comprises a mat unit including a hip receiving portion for supporting a hip portion of a care-dependent person, an upper half body receiving portion for supporting an upper half body portion that is upper than the hip portion, and a lower half body portion for supporting a lower half body portion that is lower than the hip portion; a bed frame unit for supporting the mat unit; and a toilet unit moveable to an opening portion formed when the hip receiving portion is stored in a lower portion. The lower half body portion comprises a thigh receiving portion that supports thigh portions of the care-dependent person, wherein the thigh portion is lifted with rising of the thigh receiving portions.

11 Claims, 8 Drawing Sheets

(56) References Cited

U.S. PATENT DOCUMENTS

| | | | | |
|---|---|---|---|---|
| 5,842,237 | A * | 12/1998 | Hargest et al. | 4/449 |
| 6,009,570 | A * | 1/2000 | Hargest et al. | 4/449 |
| 6,725,474 | B2 * | 4/2004 | Foster et al. | 5/81.1 R |
| 2008/0256708 | A1 * | 10/2008 | Park | 5/605 |
| 2010/0083441 | A1 * | 4/2010 | Ishida | 5/604 |

FOREIGN PATENT DOCUMENTS

| | | | |
|---|---|---|---|
| JP | 2000-210343 | A | 8/2000 |
| JP | 2000-225152 | | 8/2000 |
| JP | 2000210343 | A | 8/2000 |
| JP | 2000-024918 | | 8/2001 |
| JP | 2001-212186 | A | 8/2001 |
| JP | 2002-85482 | A | 3/2002 |
| JP | 2006-175181 | A | 7/2006 |
| JP | 2009-072321 | | 4/2009 |
| JP | 2010-29343 | A | 2/2010 |
| JP | 2010-187706 | | 9/2010 |
| WO | 2008/093527 | A1 | 8/2008 |

* cited by examiner

BED FOR NURSING CARE

BACKGROUND OF THE INVENTION

1. Field of the Invention

The present invention relates to a bed for nursing care for a care-dependent person; more specifically, the invention relates to a bed for nursing care including a toilet bowl.

2. Description of the Related Art

Conventionally, considerable burden is imposed on a caregiver, such as a nurse, to nurse a care-dependent person, such as a bedridden physically challenged person or aged person. As such, in recent years the various beds for nursing care for reducing the labor and burden imposed on caregivers are proposed.

For example, among conventional beds for nursing care, there is known a bed for nursing care, in which an opening is formed at a position corresponding to a hip portion of a care-dependent person, and a toilet bowl is moved and then is set at the opening in response to operation of a switch performed by the care-dependent person at use time, and the opening is closed by a mat during non-use time.

The above is described in, Japanese Unexamined Patent Application Publication No. 2001-212186 (Patent Document 1).

However, with the conventional bed for nursing care as described above, problems arise in that, since the care-dependent person cannot assume a posture necessary for easy excretion, the care-dependent person cannot easily carry out excretion and in that excretion is needed to be carried out in a painstaking posture.

Other problems arising therewith include those in that, since the caregiver needs to assume an unnatural posture on the mat to carry out colonic irrigation for the care-dependent person, it is difficult for the caregiver to carry out the colonic irrigation, and in that there is a risk of fouling the mat and the like during colonic irrigation.

SUMMARY OF THE INVENTION

The present invention is made to solve the problems as described above. Accordingly, an object of the invention is to provide a bed for nursing care that enables a care-dependent person to carry out excretion in an easy, effortless posture, that enables a caregiver to easily carry out colonic irrigation, and that eliminates a risk of fouling a mat and the like.

In order to achieve the object described above, according to the present invention, a bed for nursing care of the present invention comprises a mat unit including a hip receiving portion for supporting a hip portion of a care-dependent person, an upper half body receiving portion for supporting an upper half body portion that is upper than the hip portion, and a lower half body portion for supporting a lower half body portion that is lower than the hip portion; a bed frame unit for supporting the mat unit; and a toilet unit moveable to an opening portion formed when the hip receiving portion is stored in a lower portion, wherein the lower half body portion comprises a thigh receiving portion that supports thigh portions of the care-dependent person, wherein the thigh portion is lifted with rising of the thigh receiving portions.

It is preferable that the bed for nursing care further comprises left and right thigh receiving portion drive mechanisms that cause the thigh receiving portions to rise, wherein the left and right thigh receiving portion drive mechanisms each comprise a lifting device that extends a rod that supports the thigh receiving portion from a lower portion, and a slide device that causes a lower portion of the lifting device to slide to a head end side or a foot end side; and when lifting the thigh portion, the lifting device causes the rod to extend, and the slide device causes the lower portion of the lifting device to slide to the foot end side, thereby causing the thigh receiving portion to tilt to the head end side and concurrently to rise.

In addition, it is preferable that the thigh receiving portion is provided to be splittable into thigh receiving portions on left and right sides and comprises left and right slide devices that, respectively, cause the thigh receiving portions to slide along the directions of leftwardly and rightwardly separating from and approaching each other; and when lifting the thigh portions, the left and right slide devices cause the respective thigh receiving portions to slide along the directions of leftwardly and rightwardly separating from each other.

Further, it is preferable that left and right outer side portions of the hip receiving portion are each split into a head end side portion and a foot end side portion; and when the thigh receiving portion rises, a pivotal connection portion between the head end side portion and the foot end side portion rises, and left and right outer side portions of the hip receiving portion each become in a mountain-fold shape, whereby a clearance is created in a space formed with the thigh receiving portion.

Further, it is preferable that the invention further comprises a hip receiving portion storage device that downwardly takes up and concurrently move a portion supporting the hip receiving portion of the bed frame unit to the head end side to thereby store the hip receiving portion in a lower portion.

Further, it is preferable that the toilet unit comprises a container having an opening in an upper portion thereof; a vinyl bag that is accommodated in the container and that has an openable or closable upper portion; and a urine draw-in device that is liftable on the foot end side of the container and that has an draw-in opening at an upper end, wherein in case the care-dependent person is male, the draw-in opening of the urine draw-in device is lifted to an upper portion of the container, and in case the care-dependent person is female, the foot end side portion of the vinyl bag is lifted to an upper portion of the container.

Further, it is preferable that an upper end of the vinyl bag is hanged on a head end side hook that is provided on the head end side of an upper end of the container and on a head end side hook that is provided on the foot end side of the container and that lifts with the urine draw-in device, thereby accommodating the vinyl bag in the container.

Further, it is preferable that the head end side hook is provided to be slidable to the foot end side.

Further, it is preferable that a bottom plate having a foot end side portion that rises along with rising motion of the urine draw-in device or the head end side hook to thereby assume a tilted posture.

Further, it is preferable that the invention further comprises a care-dependent person lifting and moving device provided for lifting and moving the care-dependent person, wherein the care-dependent person lifting and moving device comprises a support column fixed to the bed frame unit; an arm supported by the support column to be pivotable along the left, right, and vertical directions; a lifting device attached to a leading end of the arm; and a care-dependent person holding device that is detachably attached to the lifting device and that is lifted by the arm via the lifting device.

Further, it is preferable that the lifting device comprises vertical frames provided in a vertical posture and in parallel; a suspension rope routed between upper end portions of the individual vertical frames and the arm; a backboard interposed between the individual vertical frames; and springs connected to lower ends of the individual vertical frames.

Further, it is preferable that the care-dependent person holding device comprises a stuffed toy disposed on the front side of the care-dependent person; arm portions, respectively, horizontally extending along the forward-rearward direction from two shoulder portions of the stuffed toy to support underarms of the care-dependent person; and a thigh receiving portion connected to lower end portions of the springs to support the thigh portions of the care-dependent person.

Further, it is preferable that the care-dependent person holding device comprises leg portions, respectively, horizontally extending rearwardly from left and right lower end portions of the stuffed toy; a thigh receiving portion comprises a cylindrical sponge member and a belt that is inserted into the sponge member and that is connected to the lower end portions of the springs; and hook portions latchable onto the belt are, respectively, provided in rear end portions of the leg portions.

According to the present invention, it is possible to provide a bed for nursing care that enables a care-dependent person to carry out excretion in an easy, effortless posture, that enables a caregiver to easily carry out colonic irrigation, and that eliminates a risk of fouling a mat and the like.

DESCRIPTION OF THE PREFERRED EMBODIMENTS

One embodiment of the present invention will be described herebelow with reference to the drawings.

Figure 1:
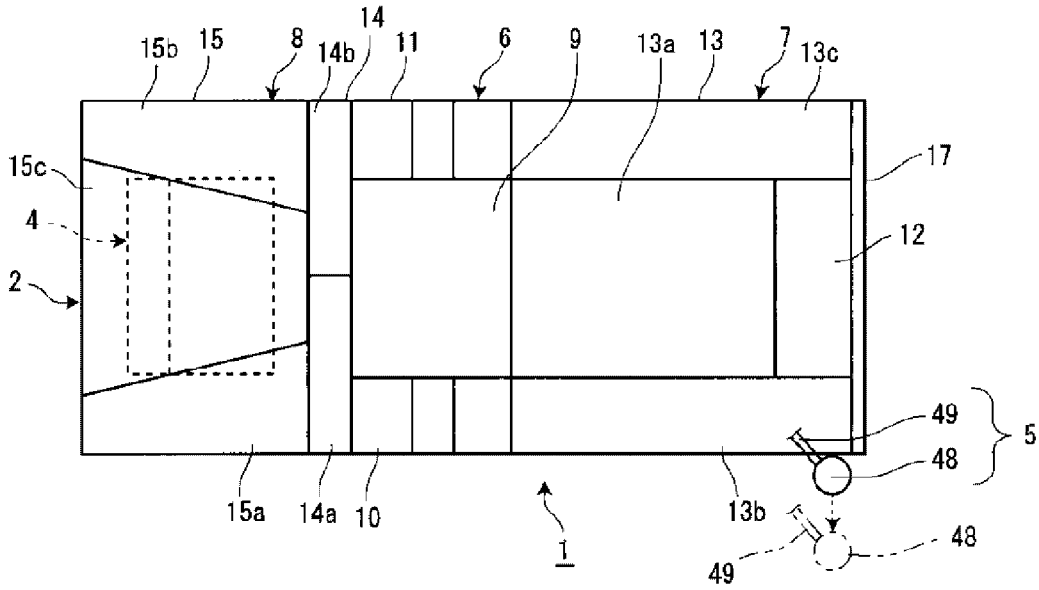
FIG. 1 is a plan view showing a bed for nursing care according to one embodiment of the present invention.
Figure 2:
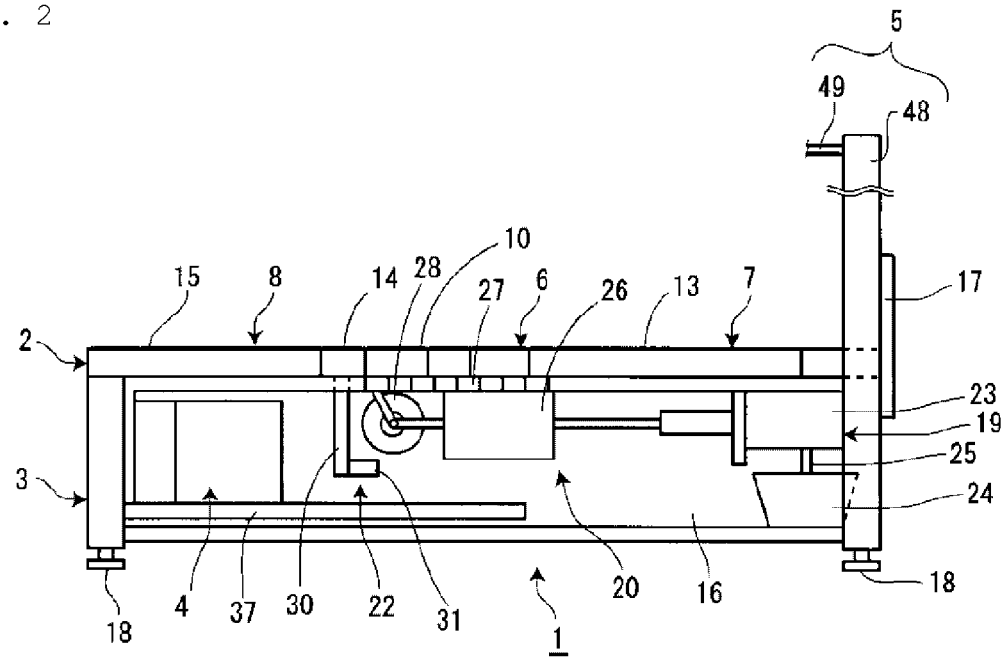
FIG. 2 is a side view showing the bed for nursing care according to the one embodiment of the present invention.

As shown in FIGS. 1 and 2, a bed for nursing care 1 according to one embodiment of the present invention is configured to include a mat unit 2; a bed frame unit 3 for supporting the mat unit 2; a toilet unit 4; a toilet unit 4 provided under the mat unit 2; and a care-dependent person lifting and moving device 5 attached on a head portion side of the bed frame unit 3.

The mat unit 2 is split into a hip receiving portion 6 for supporting a hip portion of a care-dependent person P lying down on the bed for nursing care 1; an upper half body receiving portion 7 for supporting an upper half body, which is upper than the hip portion; and a lower half body receiving portion 8 for supporting a lower half body, which is lower than the hip portion.

The hip receiving portion 6 is split into a central portion 9, and left and right outer side portions 10, 11. The central portion 9 is formed to be storable under the mat unit 2. In addition, the left and right outer side portions 10, 11 are, respectively, split into head end side portions 10*a*, 11*a*; foot end side portions 10*b*, 11*b*; pivotal connection portions 10*c*, 11*c* between the head end side portions 10*a*, 11*a* and the foot end side portions 10*b*, 11*b*. As the individual pivotal connection portions 10*c*, 11*c* rise, the head end side portions 10*a*, 11*a* and the foot end side portions 10*b*, 11*b* are tilted, the left and right outer side portions 10, 11 are moved to be in a mountain-fold shape.

An upper half body receiving portion 7 is split into a head receiving portion 12 for supporting a head portion of the care-dependent person P lying down on the bed for nursing care 1; and a body receiving portion 13 for supporting a body portion of the care-dependent person P. The head receiving portion 12 is detachably provided. A central portion 13*a* of the body receiving portion 13 is formed to be slightly lower than left and right two-side portions 13*b*, 13*c* thereof. The upper half body receiving portion 7 is provided to be pivotable through a drive source and transmission mechanism (not shown) about the foot end side portion that acts as the fulcrum (refer to FIG. 4). For this drive source, any one of electric and pneumatic driving devices, such as electric motors and actuators, can be used. In addition, for the transmission mechanism, a link mechanism, gears, belt, or the like can be used. However, any of them can be implemented using an existing known technique, detailed descriptions thereof are not presented herein.

The lower half body receiving portion 8 is split into a thigh receiving portion 14 for supporting thigh portions of the care-dependent person P lying down on the bed for nursing care 1; a lower thigh receiving portion 15 for supporting the lower thigh portion of the care-dependent person P. Further, the thigh receiving portion 14 is split into the left and right thigh receiving portions 14*a*, 14*b*. The left and right thigh receiving portions 14*a*, 14*b* are configured to be slidable along the directions of leftwardly and rightwardly separating from and approaching each other and to be able to tilt and concurrently rise. The lower thigh receiving portion 15 is split into left and right outer side portions 15*a*, 15*b* and a central portion 15*c*. The central portion 15*c* is formed to be detachable.

The bed frame unit 3 is formed in the manner that a metallic square pipe is disposed on the outer circumference to have a space 16 in the inside thereof. A headboard 17 is attached to the head portion side of the bed frame unit 3, and leg portions 18 individually are attached to lower portions at four corners of the bed frame unit 3. In the space 16 of the bed frame unit 3, the head portion side, a washing device 19, a hip receiving portion storage device 20, left and right outer side portion driving devices 21 for a hip receiving portion, and thigh receiving portion drive mechanisms 22 are disposed in that order.

The washing device 19 is configured to include a wash basin 23 disposed under the head receiving portion 12; and a bucket 24 disposed under the wash basin 23. A drain pipe 25 of the wash basin 23 is open over the bucket 24. The wash basin 23 can be used by detaching the head receiving portion 12 of the mat unit 2.

The hip receiving portion storage device 20 is configured to include a slide device 26 that is slid by the drive source, such as actuator, to the head portion side or the foot end side; and a take-up device 28 that is capable of downwardly taking up a portion 27 provided for supporting the hip receiving portion 6.

The left and right outer side portion driving devices 21, respectively, are provided under the head end side portions 10*a*, 11*a* and the foot end side portions 10*b*, 11*b* and the individual pivotal connection portions 10*c*, 11*c* of the mat unit 2, and are configured of actuators or the like that lift the individual pivotal connection portions 10*c*, 11*c*.

The thigh receiving portion drive mechanisms 22 are each configured to include a lifting device 30 and a slide device 31. The lifting device 30 extends a rod 29 that supports the thigh receiving portion 14 from the lower portion. The slide device 31 causes a lower portion of the lifting device 30 to slide either to the head portion side or to the foot end side. The lifting device 30 causes the rod 29 to extend, and the slide device 31 causes the lower portion of the lifting device 30 to slide to the foot end side, thereby enabling the mechanisms 22 to cause the thigh receiving portion 14 to tilt and concurrently to rise to the head portion side. In addition, the thigh receiving portion drive mechanisms 22, respectively, include left and right slide devices (not shown) that cause the thigh receiving portions 14*a*, 14*b* to slide along the directions of leftwardly and rightwardly separating from and approaching each other.

Figure 4:
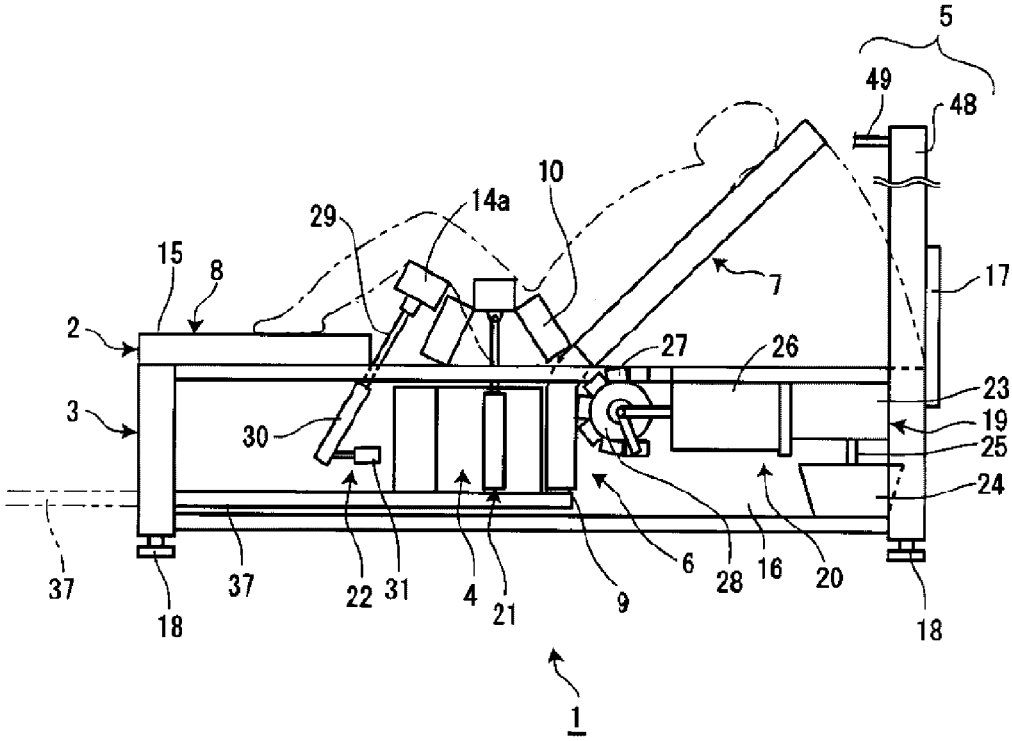
FIG. 4 is a side view showing a state where the care-dependent person carries out excretion on the bed for nursing care according to the one embodiment of the present invention.
Figure 5:
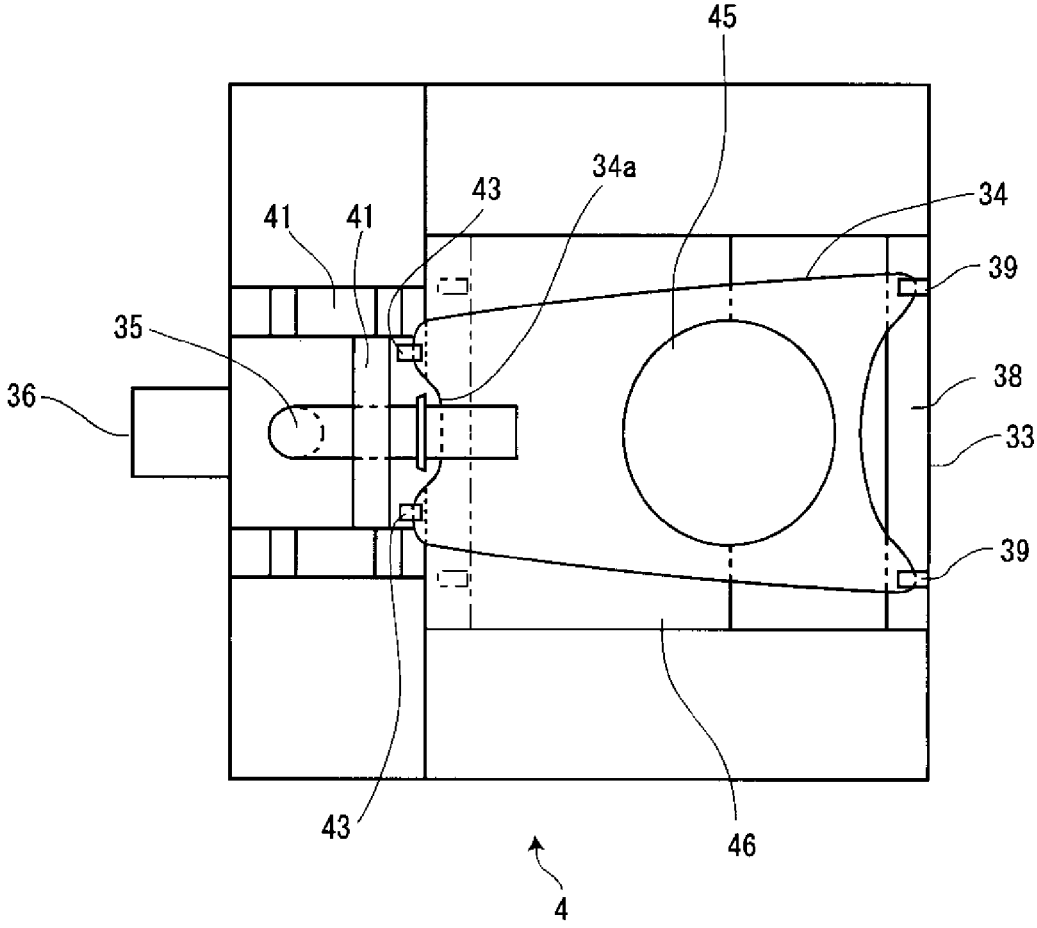
FIG. 5 is a plan view showing a toilet unit of the bed for nursing care according to the one embodiment of the present invention.
Figure 6:
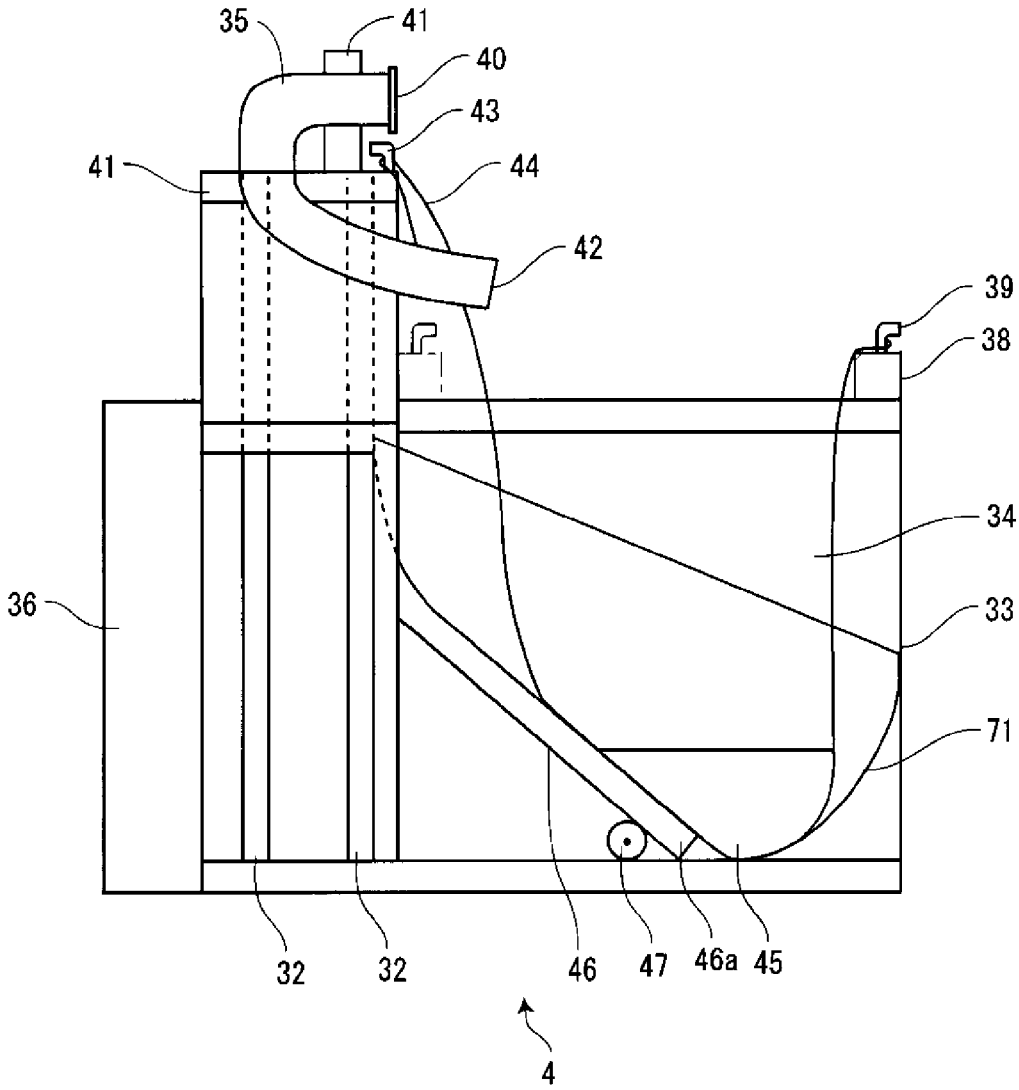
FIG. 6 is a cross sectional view showing the toilet unit of the bed for nursing care according to the one embodiment of the present invention.
Figure 7:
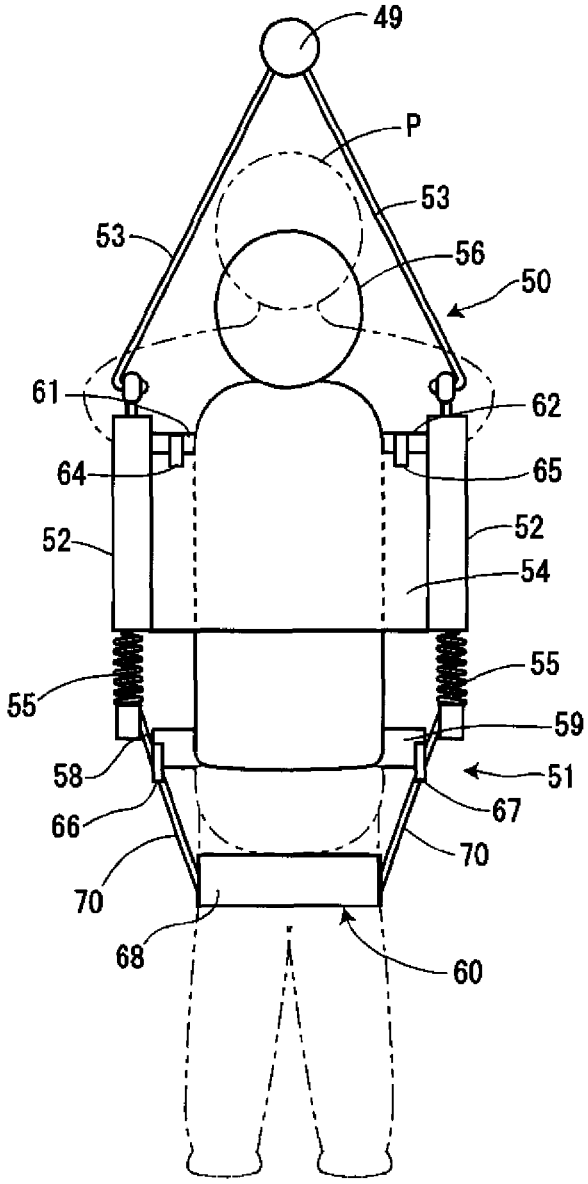
FIG. 7 is a rear view showing a care-needing-person lifting and moving device of the bed for nursing care according to the one embodiment of the present invention.
Figure 8:
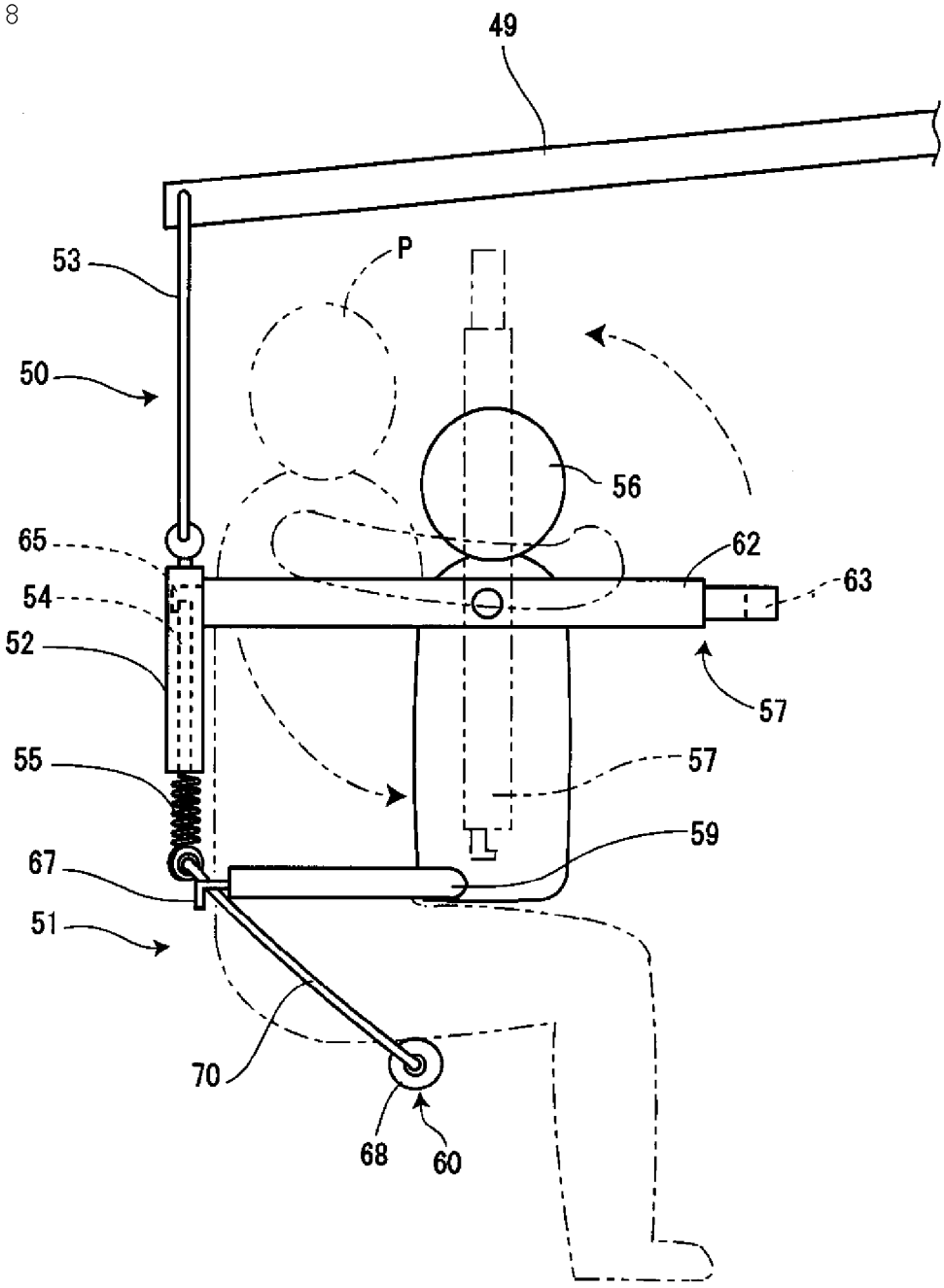
FIG. 8 is a side view showing the care-needing-person lifting and moving device of the bed for nursing care according to the one embodiment of the present invention.

As shown in FIGS. 5 and 6, the toilet unit 4 is configured to include a bucket-shaped polyethylene container 33; a urine draw-in device 35; and a urine draw-in device lifting device 36. The bucket-shaped polyethylene container 33 has an opening in an upper portion. The vinyl bag 34 is stored in the container 33 via a boat-shaped internal container 71, and has an openable or closable upper portion. In addition, the urine draw-in device lifting device 36 is liftable on the foot end side of the container 33, and has an draw-in opening 40 at an upper end. The toilet unit 4 is provided to be slidable along the rails 37 that extend in parallel to each other to the foot end side from a portion below the hip receiving portion 6. The rails 37 can be draw out from the foot end side of the bed frame unit 3 (refer to FIGS. 2 to 4).

An upper end of the container 33 is provided with a horizontal member 38 to be slidable along the directions of the foot end side and the head portion side. Head end side hooks 39 individually are provided in two, left and right portions on the upper face of the horizontal member 38. In addition, a seat (not shown) split into left and right portions is provided above the container 33 to be slidable along the directions of leftwardly and rightwardly separating from and approaching each other. At the time of excretion by the care-dependent person P, the hip portion of the care-dependent person P can be supported by these seat.

The urine draw-in device 35 is made of bellows hose and supported by a square pipe-shaped support member 41 of a bellows-hose type so that a draw-in opening 40 at an upper end assumes horizontal posture towards the head portion side. While being supported by the support member 41, the urine draw-in device 35 is moved by the urine draw-in device lifting device 36 upwardly of the container 33 along the parallel guide rails 32, and an opening 42 of the urine draw-in device 35 at a lower end is opened on the vinyl bag 34 stored in the container 33. The opening 42 at a lower end of the urine draw-in device 35 may be connected to an independent vacuum device (not shown), or may be arranged to flow urine into a dedicated container (not shown), for example.

Foot end side hooks 43 respectively are provided in two, left and right portions on the head portion side of the support member 41. The grip 44 of the vinyl bag 34 is hanged on the head end side hooks 39 and the foot end side hooks 43, thereby accommodating the vinyl bag 34 in the container 33. For the vinyl bag 34, a vinyl bag provided in shopping at a store such as a supermarket or convenience store. A high-absorbent throwaway stool disposal material 45 is provided inside the vinyl bag 34.

A bottom plate 46 is provided in a bottom portion of the container 33. A roller 47 is pivotally provided in a head end side end portions 46*a* of the bottom plate 46, and a foot end side end portion's end portion (not shown) of the bottom plate 46 is pivotally provided in the support member 41. Thereby, along with rising motion of the urine draw-in device 35 supported by the support member 41, the foot end side end portion's end portion of the bottom plate 46 rises. In addition, with the movement of the head end side end portions 46*a* to the foot end side, the bottom plate 46 assumes a tilted posture.

The care-dependent person lifting and moving device 5 is configured to include a support column 48, an arm 49, a lifting device 50, and a care-dependent person holding device 51. The support column 48 is provided with a lower end portion vertically disposed at a corner section on the head portion of the bed frame unit 3, and is extensible in the vertical posture. The arm 49 is cantilevered at an upper end portion of the support column 48, and is pivotable along the left, right, and vertical directions. The lifting device 50 is attached to the leading end of the arm 49. The care-dependent person holding device 51 is lifted by the arm 49 via the lifting device 50 through driving of a driving device (not shown).

Figure 3:
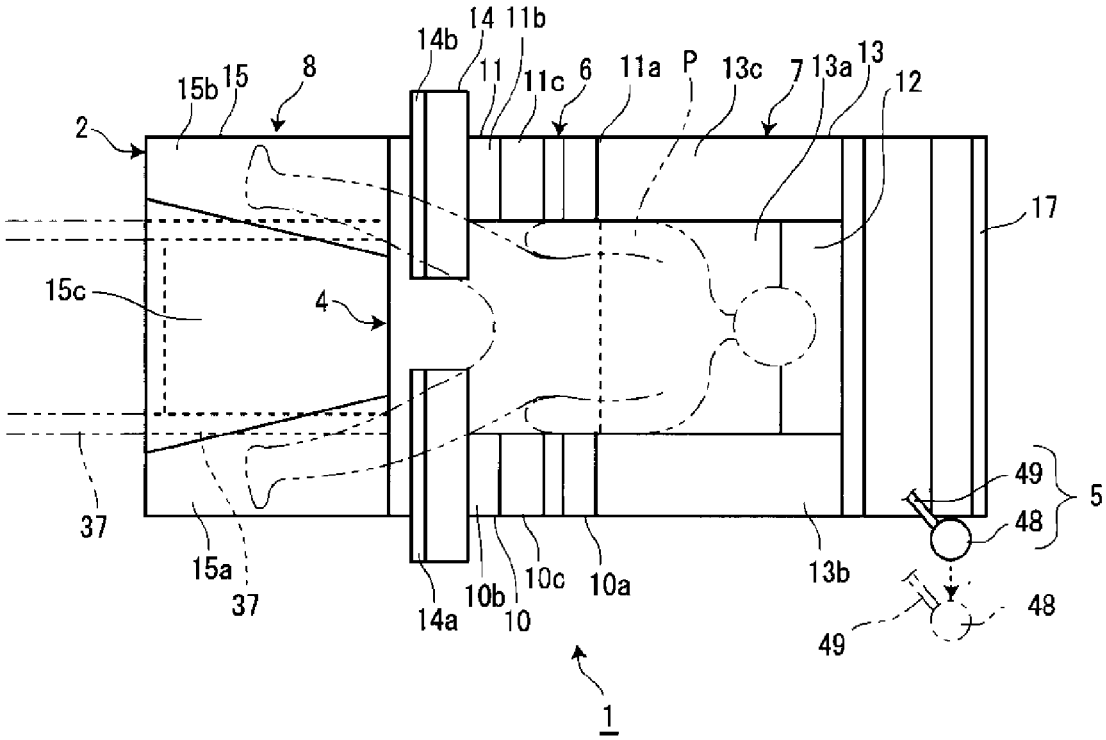
FIG. 3 is a plan view showing a state where a care-dependent person carries out excretion on the bed for nursing care according to the one embodiment of the present invention.

As shown by double-dotted chain line in FIGS. 1 and 3, the support column 48 is provided to be slidable along the direction of separating from the mat unit 2.

The lifting device 50 is configured to include vertical frames 52 provided with a vertical posture and in parallel to each other; a suspension rope 53 routed between upper end portions of the individual vertical frames 52 and the arm 49; a backboard 54 interposed between the individual vertical frames 52; and springs 55 connected to lower ends of the individual vertical frames 52. The surface of a backboard 49 is covered with a cushion material (not shown), such as sponge.

The care-dependent person holding device 51 includes a stuffed toy 56 disposed on the front side of the care-dependent person P; arm portions 57, respectively, horizontally extending along the forward-rearward direction from two shoulder portions of the stuffed toy 56 to support the underarms of the care-dependent person P; leg portions 58, 59, respectively, horizontally extending rearwardly from left and right lower end portions of the stuffed toy 56; and a thigh receiving portion 60 connected to other end portions of the springs 55 to support the thigh portions of the care-dependent person P.

The stuffed toy 56 has the shape of the panda, bear, gorilla, pig, or the like, and is provided so that the front thereof faces the care-dependent person P.

The arm portions 57, respectively, include cylindrical left and right frames 61, 62 that extend in parallel along the forward-rearward direction; and inner frames 63 that each have an angular U shape as viewed in a plan view and that are inserted into the left and right frames 61, 62 to be slidable in the forward-rearward direction. The arm portions 57, respectively, are provided to be pivotable by 90 degrees about two shoulder portions of the stuffed toy 56, which act as a fulcrums, along the vertical direction. In addition, the inner frames 63 of the arm portions 57, respectively, are urged forwardly with respect to the left and right frames 61, 62 via springs (not shown) interposed between the left and right frames 61, 62. Connection members 64, 65, respectively, are attached to left and right rear end portions, and are provided detachably from both left and right ends of the backboard 54. Thereby, front end portions of the inner frames 63 are depressed in opposition to the urging force of the springs to slide rearwardly with respect to the left and right frames 61, 62. As a result, the connection members 64, 65 protrude from rear ends of the left and right frames 61, 62 and then are latched with both left and right ends of the backboard 54. This causes arm portions 57 to be fixed to the lifting device 50. In addition, the arm portions 57 are each formed such that, when a dial-type operative portion (not shown) is leftwardly and rightwardly pivoted, a front frame 63 is formed to extend or telescopically move leftwardly and rightwardly, and the width in the left-right direction can be adjusted to the shoulder length of the care-dependent person P.

The thigh receiving portion 60 includes a cylindrical sponge member 68 and a strip-shaped belt 70 that is inserted into the sponge member 68 and that has two end portions to which connectors (not shown) are individually attached. The individual connectors are detachable from the lower end portions of the springs 55.

Hook portions 66, 67, respectively, are attached to rear end portions of the left and right leg portions 58, 59, and can be latched onto the belt 70.

In case the care-dependent person holding device 51 thus configured is used to lift and move the care-dependent person P, the upper half body portion of the care-dependent person P is placed between the stuffed toy 56 and the backboard 54 so that care-dependent person P faces the stuffed toy 56, left and right frames 61, 62 of the arm portions 57 are disposed, respectively, under the two arms of the care-dependent person P, and concurrently, the sponge member 68 is disposed under the hip portion of the care-dependent person P. When the care-dependent person P is lifted in this state, the care-dependent person P is placed to assume a posture that enables the care-dependent person P to bend forward such as to hold the stuffed toy 56. Hence, the care-dependent person P can be safely and securely moved to a desired position. In addition, when the care-dependent person P is lifted, the stuffed toy 56 contacts with the front side of the care-dependent person P, and a cushion material covering the surface of the backboard 54 contacts with the dorsal surface thereof, and a sponge member 68 contacts with the hip portion thereof. Further, the springs serves to adjust the height of care-dependent person holding device 51 to the sitting height of the care-dependent person P. Hence, discomfort is not caused for the care-dependent person P.

Next, operation of the bed for nursing care 1 configured as described above will be described herebelow with reference to the drawings.

First, operation of the bed for nursing care 1 at the time of excretion by the care-dependent person P will be described herebelow. As shown in FIGS. 3 and 4, upon selection of an operation button for excretion from the remote controller (not shown), the drive source and transmission mechanism cause the upper half body receiving portion 7 to pivot upwardly (along the counterclockwise direction as viewed in FIG. 4) about the foot end side portion that acts as a fulcrum. As a result, the upper half body portion of the care-dependent person P is raised.

In addition, the lifting device 30 of the thigh receiving portion drive mechanism 22 causes the rod 29 to extend. Further, the slide device 31 causes the lower portion of the lifting device 30 to slide to the foot end side. The above causes the individual left and right thigh receiving portions 14*a*, 14*b* to tilt and concurrently to lift to the head portion side. Further, the left and right slide devices cause the left and right thigh receiving portions 14*a*, 14*b* to slide along the direction of leftwardly and rightwardly separating from each other. Thereby, the thigh portions of the care-dependent person P are lifted and spread apart leftwardly and rightwardly.

In addition, at this time, the left and right outer side portion driving devices 21 cause the individual pivotal connection portions 10*c*, 11*c* of the head end side portions 10*a*, 11*a* and the foot end side portions 10*b*, 11*b* to lift. Thereby, the head end side portions 10*a*, 11*a* and the foot end side portions 10*b*, 11*b* are tilted, and the left and right outer side portions 10, 11 each form a mountain-fold shape. In addition, clearances are, respectively, created between the left and right outer side portions 10, 11 of the hip receiving portion 6, a foot end side portion of the upper half body receiving portion 7, and the head end side portions of the left and right thigh receiving portions 14*a*, 14*b*. This enables smooth and secure rotational motion of the upper half body receiving portion 7 and rising motion of the left and right thigh receiving portions 14*a*, 14*b*.

Further, the slide device 26 of the hip receiving portion storage device 20 slides to the head portion side, and concurrently, the take-up device 28 downwardly takes up the portion 27 supporting the hip receiving portion 6. Thereby, an opening is formed below the central portion 9 of the hip receiving portion 6. Through this opening, the hip receiving portion 6 is vertically suspended to the central portion 9 of the space 16.

In addition, at this time, the central portion 15*c* of the lower thigh receiving portion 15 is detached, the toilet unit 4 is slid along the rails 37 downwardly of the opening and then is set to a predetermined position, and the urine draw-in device lifting device 36 is used to lift the urine draw-in device 35 upwardly of the container 33. Then, the hip portion of the care-dependent person P is placed over the seat of the toilet unit 4. In case the care-dependent person P is male, the male's genital organ is caused to be inserted into the draw-in opening 40 of the urine draw-in device 35. Then the care-dependent person P is caused to assume the excretion posture and to carry out excretion into the vinyl bag 34.

In this case, the care-dependent person P is in a state where the thigh portions thereof are lifted by the left and right thigh receiving portions 14*a*, 14*b*. Hence, the care-dependent person P can assume a natural, comfortable posture to exert physical power necessary for excretion. In addition, at the time of excretion, in case the care-dependent person P is male, urine flows through the urine draw-in device 35 and then is collected into the vinyl bag 34. In addition, in the case the care-dependent person P is female, the draw-in opening 40 (refer to FIG. 5) of the vinyl bag 34 prevents urine from spattering externally of the vinyl bag 34. In addition, along with the rising motion of the urine draw-in device 35, the bottom plate 46 of the container 33 is caused to assume a tilted posture (refer to FIG. 6). Thereby, excrements accumulated in the vinyl bag can easily be collected into a single portion. Thus, collection work for excrements can easily be carried out, therefore enabling caregiver's labor saving to be implemented.

After completion of the excretion by the care-dependent person P, the urine draw-in device lifting device causes the urine draw-in device 35 to move down. Concurrently, the horizontal member 38 is slid to the foot end side along the upper end of the container 33, and an opening located above the vinyl bag 34 is closed. Then, the caregiver draws out the toilet unit 4 from foot end side of the bed frame unit 3 along the rails 37, detaches the grip 44 of the vinyl bag 34 from the individual hooks 39, 43, and disposes of excrements entirely with the vinyl bag 34 to a predetermined location.

Next, operation at the time of colonic irrigation for the care-dependent person P will be described herebelow. Similarly as in the above-described case of excretion by the care-dependent person P, upon selection of an operation button for colonic irrigation, the upper half body portion of the care-dependent person P is raised by the upper half body receiving portion 7. Concurrently, the thigh portions of the care-dependent person P are lifted and the legs thereof are spread apart leftwardly and rightwardly by the thigh receiving portions 14*a*, 14*b*.

In addition, with rising of the individual pivotal connection portions 10*c*, 11*c*, the left and right outer side portions 10, 11 individually form a mountain-fold shape (a shape formed in the paper-craft art). In addition, clearances are, respectively, created between the left and right outer side portions 10, 11 of the hip receiving portion 6, a foot end side portion of the upper half body receiving portion 7, and the head end side portions of the left and right thigh receiving portions 14*a*, 14*b*.

Further, the hip receiving portion storage device 20 causes the central portion 9 of a hip receiving portion 9 to suspend, thereby forming a space. In this space, there is set a toilet unit (not shown) in place of the toilet unit 4 described above. The toilet unit includes a container larger in volumetric capacity than the container 33 set on the rails 37 and that is set in that space by being slid to the above-mentioned space described above. In this state, the hip portion of the care-dependent person P is placed on the seat of the toilet unit. The caregiver sits on a chair (not shown) disposed in a space formed by detachment of the central portion 15*c* of the lower thigh receiving portion 15, and in that posture, carries out colonic irrigation for the care-dependent person P. Thus, during colonic irrigation, the caregiver can easily carry out colonic irrigation work without needing to assume an unnatural posture on the mat unit 2. In addition, there is no risk of fouling a mat and the like during colonic irrigation work.

After completion of colonic irrigation, the caregiver draws out the toilet unit 4 from foot end side of the bed frame unit 3 along the rails 37, detaches the vinyl bag from the hooks, and disposes of excrements to the predetermined location.

Figure 9:
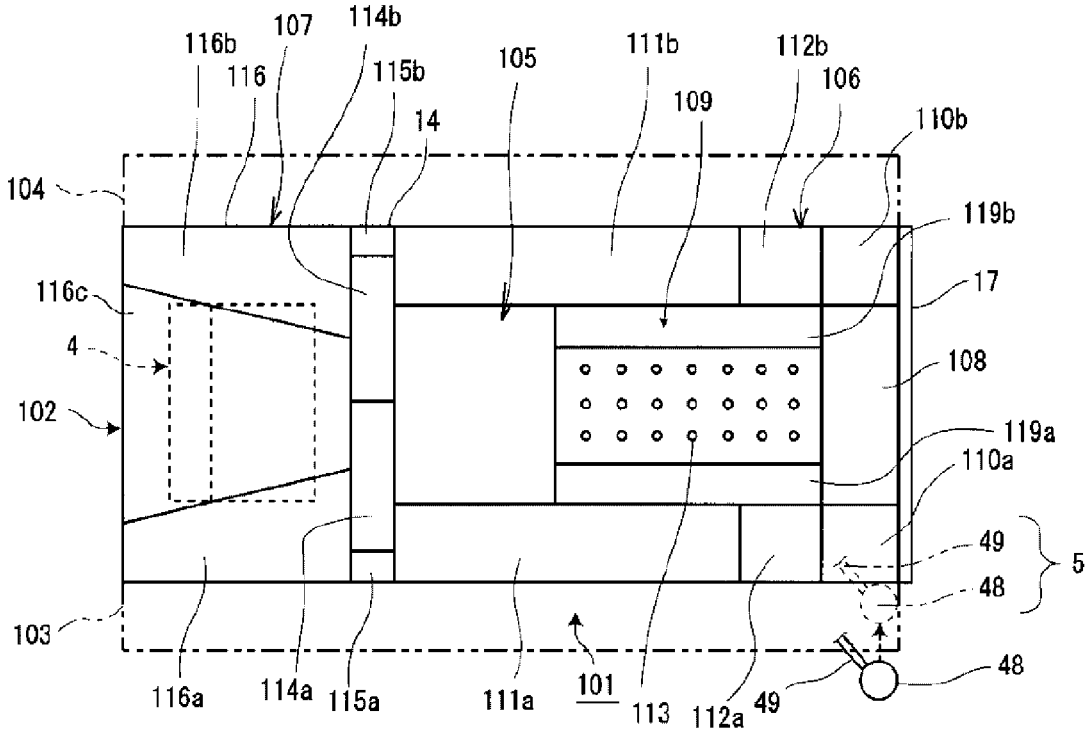
FIG. 9 is a plan view showing a bed for nursing care according to an other embodiment of the present invention.
Figure 10:
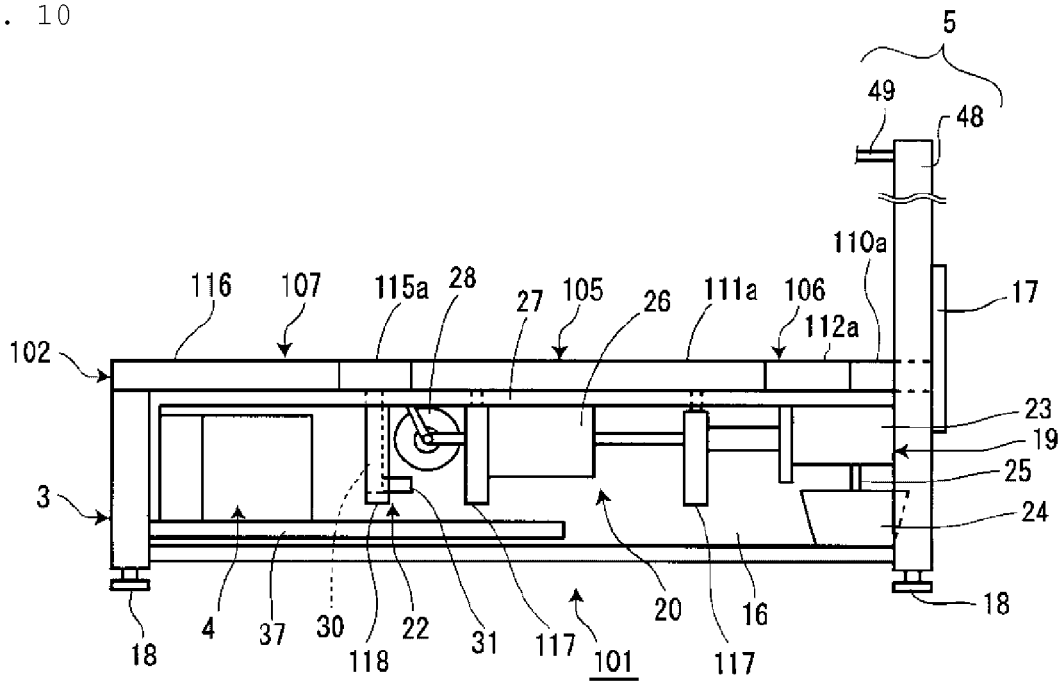
FIG. 10 is a side view showing the bed for nursing care according to the other embodiment of the present invention.
Figure 11:
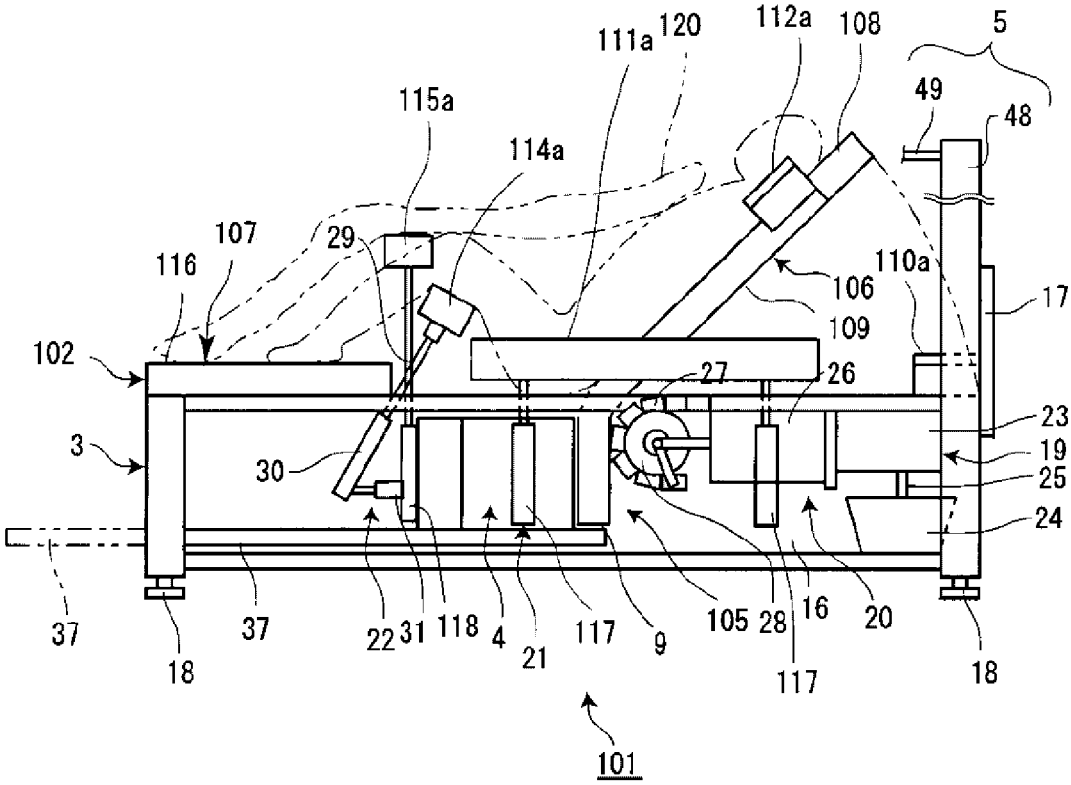
FIG. 11 is a side view showing a state where the care-dependent person carries out excretion on the bed for nursing care according to the other embodiment of the present invention.

Next, a bed for nursing care 101 according to another embodiment of the present invention will be described herebelow with reference to FIGS. 9 to 11. In the description below, for the same configurations as those in the embodiment described above, identical reference numerals as used in FIGS. 1 to 9 are used also in FIGS. 8 to 11, and detailed descriptions thereof are omitted for simplicity.

In a mat unit 102 of the bed for nursing care 101 according to the present embodiment, lateral portions 103, 104 having a width of about 30 cm are, respectively, detachable from the left and right sides. In the state where the lateral portions 103, 104 are attached, the width of the mat unit 102 is about 150 cm, for example.

The mat unit 102 is split into a hip receiving portion 105 for supporting a hip portion of a care-dependent person P lying down on the bed for nursing care 101; an upper half body receiving portion 106 for supporting an upper half body, which is upper than the hip portion; and a lower half body receiving portion 107 for supporting a lower half body, which is lower than the hip portion. The hip receiving portion 105 is formed to be storable under the mat unit 102.

The upper half body receiving portion 106 is split into a head receiving portion 108 for supporting a head portion of the care-dependent person P lying down on the bed for nursing care 101; a body receiving portion 109 for supporting a body portion of the care-dependent person P; audio facility storage portions 110*a*, 110*b* provided on both the left and right sides of the head receiving portion 108; armrest portions 111*a*, 111*b* provided on both the left and right sides of the hip receiving portion 105 and the body receiving portion 109; and left and right falling prevention portions 112*a*, 112*b* provided on both the left and right sides of an upper portion of the body receiving portion 109. The upper half body receiving portion 106 is provided to be pivotable through a drive source and transmission mechanism (not shown) about the foot end side portion that acts as a fulcrum (refer to FIG. 11). For this drive source, any one of electric and pneumatic driving devices, such as electric motors and actuators, can be used. In addition, for the transmission mechanism, a link mechanism, gears, belt, or the like can be used. However, any of them can be implemented using an existing known technique, a detailed description thereof are not made herein.

The head receiving portion 108 is detachably provided, and many small openings 113 are formed in the body receiving portion 109. Through these small openings 113, minus ions controlled to a predetermined temperature are expelled from minus ion generator (not shown), which is installed in the space 16 of the bed frame unit 3, to the back, waist, and hip portions of the care-dependent person P. This prevents occurrence of bedsore with the care-dependent person P and enables the care-dependent person P to comfortably sleep. In addition, air mattress 119*a*, 119*b* are provided in left and right side portions of the body receiving portion 109. With any expanded one of the air mat matresses 119*a*, 119*b*, positional-change motion of the care-dependent person P can also be supported.

The audio facility storage portions 110*a*, 110*b* are provided to be tiltable leftwardly and rightwardly to cause the head portion side of the care-dependent person P to outstand. Speakers and microphones (any of which is not shown) are stored in the audio facility storage portions 110*a*, 110*b*. In this configuration, when a predetermined operation is performed, the audio facility storage portions 110*a*, 110*b* tilt leftwardly and rightwardly, thereby causing the speakers and the microphones to be disposed close to the ears and mouth of the care-dependent person P. This enables the care-dependent person P to communicate with a caregiver staying in the same room with the care-dependent person P or in a different room at all times or in cases of emergency.

The lower half body receiving portion 107 is split into left and right thigh receiving portions 114*a*, 114*b* for supporting left and right thigh portions of the care-dependent person P lying down on the bed for nursing care 101; comforter lift-up portions 115*a*, 115*b* individually provided on both sides of the thigh receiving portions 114*a*, 114*b*; and a lower thigh receiving portion 116 for supporting the lower thigh portion of the care-dependent person P. The left and right thigh receiving portions 114*a*, 114*b* are configured to be slidable along the directions of leftwardly and rightwardly separating from and approaching each other and to be able to tilt and concurrently to rise. In addition, the lower thigh receiving portion 116 is split into left and right outer side portions 116*a*, 116*b* and a central portion 116*c*. The central portion 116*c* is formed to be detachable.

In the space 16 of the bed frame unit 3, armrest portion driving device 117 and comforter lift-up portion driving devices 118 are provided in addition to the washing device 19, the hip receiving portion storage device 20, the left and right outer side portion driving devices 21 for a hip receiving portion, and the thigh receiving portion drive mechanisms 22. The armrest portion driving devices 117 and the comforter lift-up portion driving devices 118 are configured of a plurality of actuators or the like that lift the individual armrest portions 111*a*, 111*b* and comforter lift-up portions 115*a*, 115*b*.

Next, operation of the bed for nursing care 101 configured as described above will be described herebelow with reference to the drawings.

First, operation of the bed for nursing care 101 at the time of excretion by the care-dependent person P will be described herebelow. As shown in FIG. 11, upon selection of an operation button for excretion from the remote controller (not shown), the comforter lift-up portion driving devices cause the individual comforter lift-up portions 115*a*, 115*b* to rise and to pivot by substantially 90 degrees to left and right outer sides. The comforter 120 is thereby lifted and pulled left and right, and slack of the comforter 120 is prevented. This enables subsequent excretion motion of the care-dependent person P to be smooth and easy.

In addition, the lifting device 30 of the thigh receiving portion drive mechanism 22 causes the rod 29 to extend. Concurrently, the lower portion of the slide device causes the lifting device 30 to slide to the foot end side. Consequently, the left and right thigh receiving portions 114*a*, 114*b* individually are tilted and concurrently risen to the head portion side. In addition, the left and right slide devices cause the left and right thigh receiving portions 114*a*, 114*b* to slide along the direction of leftwardly and rightwardly separating from each other. This causes the thigh portions of the care-dependent person P to be lifted and spread apart leftwardly and rightwardly. Further, at this time, a drive source (not shown) or the like works to slightly rise a hip receiving portion 105 and the body receiving portion 109, thereby lifting the waist and back of the care-dependent person P. This enables the thigh portions of the care-dependent person P to spread apart leftwardly and rightwardly without difficulty.

Then the slide device 26 of the hip receiving portion storage device 20 slides to the head portion side, and concurrently, the take-up device 28 downwardly takes up the portion 27 provided to support the hip receiving portion 105. Thereby, an opening is formed below the hip receiving portion 105, and through this opening, the hip receiving portion 105 is vertically suspended to the space 16. In addition, a lower thigh receiving portion 116 is detached, and the toilet unit 4 is slid along the rails 37 downwardly of the opening and then is lifted, thereby causing the mat unit 102 and the toilet seat to be flat.

Subsequently, with the use of the drive source or the like, the hip receiving portion 105 and the body receiving portion 109 are moved down to return to the original position. Then, the waist and back of the care-dependent person P are slightly moved down, and the hip portion of the care-dependent person P is placed over the toilet seat. Thereafter, the drive source and transmission mechanism causes the upper half body receiving portion 106 to pivot upwardly (counterclockwise as viewed in FIG. 11) about the foot end side portion, which serves as the fulcrum. Thereby, the upper half body portion of the care-dependent person P is raised to have a natural posture.

In addition, at this time, the armrest portion driving devices 117 cause left and right armrest portions 111*a*, 111*b* to rise. Concurrently, left and right falling prevention portions 112*a*, 112*b* tilt upward at substantially 45 degrees, thereby enabling the care-dependent person P to be prevented from falling left and right.

Thereafter, by the urine draw-in device lifting device 36, the urine draw-in device 35 is lifted upwardly of the container 33. In case the care-dependent person P is male, the male's genital organ is caused to be inserted into the draw-in opening 40 of the urine draw-in device 35. Then the care-dependent person P is caused to assume the excretion posture and to carry out excretion into the vinyl bag 34.

In this case, the care-dependent person P is brought into a state where the thigh portions thereof is lifted by the left and right thigh receiving portions 114*a*, 114*b*. Hence, a natural, comfortable posture to exert physical power necessary for excretion can be assumed. In addition, at the time of excretion, in case the care-dependent person P is male, urine flows through the urine draw-in device 35 and then is collected into the vinyl bag 34. In case the care-dependent person P is female, the draw-in opening 40 (refer to FIG. 5) of the vinyl bag 34 prevents urine from spattering externally of the vinyl bag 34. In addition, in association with the rising motion of the urine draw-in device 35, the bottom plate 46 of the container 33 is caused to assume a tilted posture (refer to FIG. 6). Thereby, excrements accumulated in the vinyl bag 34 can easily be collected into a single portion. Thus, excrement collection work can easily be carried out, therefore enabling caregiver's labor saving to be implemented.

After completion of the excretion by the care-dependent person P, the urine draw-in device lifting device causes the urine draw-in device 35 to move down. Concurrently, the horizontal member 38 is slid to the foot end side along the upper end of the container 33, an opening located above the vinyl bag 34 is closed. Then, the caregiver draws out the toilet unit 4 from foot end side of the bed frame unit 3 along the rails 37, detaches the grip 44 of the vinyl bag 34 from the individual hooks 39, 43, and disposes of excrements entirely with the vinyl bag 34 to a predetermined location.

Next, operation at the time of colonic irrigation for the care-dependent person P will be described herebelow. Upon selection of an operation button for colonic irrigation, the central portion 116*c* of the lower thigh receiving portion 116 is detached in a state where the posture of the care-dependent person P is held similarly as in the above-described case of excretion, the central portion 116*c* of the lower thigh receiving portion 116 is detached. The caregiver sits on a chair (not shown) disposed in a space formed by the above and carries out colonic irrigation for the care-dependent person P. Thus, during colonic irrigation, the caregiver can easily carry out colonic irrigation work without needing to assume an unnatural posture on the mat unit 102. In addition, there is no risk of fouling a mat and the like during colonic irrigation work. After completion of colonic irrigation, the caregiver draws out the toilet unit 4 from foot end side of the bed frame unit 3 along the rails 37, detaches the vinyl bag from the hooks, and disposes of excrements to the predetermined location.

As described above, in the mat unit 102 of the bed for nursing care 101 according to the present embodiment, because the lateral portions 103, 104 are attached to both the left and right sides, it has a large width (150 cm). Hence, the effects as described below can be expected.

(1) Even with falling-preventive safety pipes attached to both the left and right sides of the bed for nursing care 101, the comforter 108 having a width of 140 cm, ordinarily, is not deflected. Hence, the care-dependent person P can comfortably sleep.

(2) After the care-dependent person P is moved by the care-needing-person lifting and moving device 5 to a bathtub placed close to the bed for nursing care 101 and is bathed, the care-dependent person P is moved to the lateral portions 103, 104 from which the safety pipes are detached, the mat unit 102 can be used as a place for drying the care-dependent person P with towel or the like.

Hence, the bathing work can smoothly and easily be carried out.

The embodiments of the present invention described above are preferable embodiments of the bed for nursing care of the present invention. Hence, while there are cases where various preferable technical limitations are imposed, the technical scope of the present invention is not limited by the embodiments inasmuch as there are no descriptions particularly limiting the present invention. In addition, the components in the embodiments of the present invention as described above can be arbitrarily substituted with existing components and the like, and various variations including combinations with other existing components are possible. Further, the contents of the invention described in the claims are not limited by the description of the embodiments of the present invention.

What is claimed is:

1. A bed for nursing care comprising:

a mat unit including a hip receiving portion for supporting a hip portion of a care-dependent person, an upper half body receiving portion for supporting an upper half body portion that is upper than the hip portion, and a lower half body portion for supporting a lower half body portion that is lower than the hip portion;

a bed frame unit for supporting the mat unit;

a toilet unit moveable to an opening portion formed when the hip receiving portion is stored in a lower portion left and right thigh receiving portion drive mechanisms that cause the thigh receiving portions to rise, wherein:

the left and right thigh receiving portion drive mechanisms each comprise a lifting device that extends a rod that supports the thigh receiving portion from a lower portion, and a slide device that causes the lower portion of the lifting device to slide to a head end side or a foot end side, wherein:

the lower half body portion comprises a thigh receiving portion that supports thigh portions of the care-dependent person, wherein the thigh portions are lifted with a rising of the thigh receiving portion;

the thigh receiving portion is provided to be splittable into thigh receiving portions on left and right sides and comprises left and right slide devices that, respectively, cause the left and right thigh receiving portions to slide along the directions of leftwardly and rightwardly separating from and approaching each other;

when lifting the left and right thigh portions, the left and right slide devices cause the respective thigh receiving portions to slide along the directions of leftwardly and rightwardly, thereby separating from each other; and when lifting the thigh portions, the lifting device causes the rod to extend, and the slide device causes the lower portion of the lifting device to slide to the foot end side, thereby causing the thigh receiving portions to tilt to the head end side and concurrently to rise.

2. The bed for nursing care according to claim 1, wherein left and right outer side portions of the hip receiving portion are each split into a head end side portion and a foot end side portion; and when the thigh receiving portion rises, a pivotal connection portion between the head end side portion and the foot end side portion rises, and left and right outer side portions of the hip receiving portion form in a mountain-fold shape, such that a clearance is created in a space formed with the thigh receiving portion.

3. The bed for nursing care according to claim 1, further comprising a hip receiving portion storage device that downwardly takes up and concurrently moves a portion supporting the hip receiving portion of the bed frame unit to the head end side to thereby store the hip receiving portion in the lower portion.

4. The bed for nursing care according to claim 1, wherein the toilet unit comprises: a container having an opening in an upper portion thereof; a vinyl bag that is accommodated in the container and that has an openable or closable upper portion; and a urine draw-in device that is liftable on the foot end side of the container and that has an draw-in opening at an upper end, wherein in case the care-dependent person is male, the draw-in opening of the urine draw-in device is lifted to an upper portion of the container, and in case the care-dependent person is female, the foot end side portion of the vinyl bag is lifted to an upper portion of the container.

5. The bed for nursing care according to claim 4, wherein an upper end of the vinyl bag is hung on a head end side hook that is provided on an upper end of the container and on a head end side hook that is provided on a foot end side of the container and that lifts with the urine draw-in device, thereby accommodating the vinyl bag in the container.

6. The bed for nursing care according to claim 5, wherein the head end side hook is provided to be slidable to the foot end side.

7. The bed for nursing care according to claim 5, further including a bottom plate having a foot end side portion that rises along with the lifting motion of the urine draw-in device or the head end side hook to thereby assume a tilted posture.

8. The bed for nursing care according to claim 1, further comprising:

a care-dependent person lifting and moving device provided for lifting and moving the care-dependent person, wherein the care-dependent person lifting and moving device comprises:

a support column fixed to the bed frame unit; an arm supported by the support column to be pivotable along the left, right, and vertical directions;

a lifting device attached to a leading end of the arm; and a care-dependent person holding device that is detachably attached to the lifting device and that is lifted by the arm via the lifting device.

9. The bed for nursing care according to claim 8, wherein the lifting device comprises:

vertical frames provided in a vertical posture and in parallel;

a suspension rope routed between upper end portions of the vertical frames and the arm;

a backboard interposed between the vertical frames; and springs connected to lower ends of the vertical frames.

10. A bed for nursing care comprising:

a mat unit including a hip receiving portion for supporting a hip portion of a care-dependent person, an upper half body receiving portion for supporting an upper half body portion that is upper than the hip portion, and a lower half body portion for supporting a lower half body portion that is lower than the hip portion;

a bed frame unit for supporting the mat unit;

a toilet unit moveable to an opening portion formed when the hip receiving portion is stored in a lower portion; and a care-dependent person lifting and moving device provided for lifting and moving the care-dependent person, wherein the care-dependent person lifting and moving device comprises:

a support column fixed to the bed frame unit;

an arm supported by the support column to be pivotable along the left, right, and vertical directions;

a lifting device attached to a leading end of the arm; and a care-dependent person holding device that is detachably attached to the lifting device and that is lifted by the arm via the lifting device, and wherein the care-dependent person holding device comprises:

a stuffed toy disposed on the front side of the care-dependent person;

arm portions, respectively, horizontally extending along the forward-rearward direction from two shoulder portions of the stuffed toy to support underarms of the care-dependent person; and a thigh receiving portion connected to lower end portions of the springs to support the thigh portions of the care-dependent person.

11. The bed for nursing care according to claim 10, wherein the care-dependent person holding device comprises leg portions, respectively, horizontally extending rearwardly from left and right lower end portions of the stuffed toy;

a thigh receiving portion comprises a cylindrical sponge member and a belt that is inserted into the sponge member and that is connected to the lower end portions of the springs; and hook portions latchable onto the belt are, respectively, provided in rear end portions of the leg portions.

* * * * *